US009412549B2

(12) United States Patent
Rakuff et al.

(10) Patent No.: US 9,412,549 B2
(45) Date of Patent: Aug. 9, 2016

(54) ELECTROMAGNETICALLY ENHANCED CONTACT SEPARATION IN A CIRCUIT BREAKER

(71) Applicant: GENERAL ELECTRIC COMPANY, Schenectady, NY (US)

(72) Inventors: Stefan Rakuff, Clifton Park, NY (US); Manoj Ramprasad Shah, Latham, NY (US); Paul Robert Gemin, Cincinnati, OH (US); Ganesh Krishnamoorthy, Schenectady, NY (US); Ashraf Atalla, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 188 days.

(21) Appl. No.: 14/183,256

(22) Filed: Feb. 18, 2014

(65) Prior Publication Data

US 2015/0235793 A1 Aug. 20, 2015

(51) Int. Cl.

| | |
|---|---|
| ***H01H 77/10*** | (2006.01) |
| ***H01H 3/38*** | (2006.01) |
| ***H01H 3/46*** | (2006.01) |
| ***H01H 50/64*** | (2006.01) |
| ***H01H 3/22*** | (2006.01) |
| *H01H 9/36* | (2006.01) |

(52) U.S. Cl.

CPC ..... *H01H 77/101* (2013.01); *H01H 3/222* (2013.01); *H01H 3/38* (2013.01); *H01H 3/46* (2013.01); *H01H 50/641* (2013.01); *H01H 9/36* (2013.01); *H01H 2235/01* (2013.01)

(58) Field of Classification Search

CPC ..... H01H 1/54; H01H 77/101; H01H 3/222; H01H 2003/225; H01H 53/02; H01H 77/10; H01H 77/102; H01H 3/38; H01H 50/641; H01H 3/46; H01H 2235/01

See application file for complete search history.

(56) References Cited

U.S. PATENT DOCUMENTS

| | | | | |
|---|---|---|---|---|
| 3,873,950 | A * | 3/1975 | Guschin | H01H 77/10 335/176 |
| 4,550,299 | A | 10/1985 | Bachler | |
| RE32,882 | E | 3/1989 | Yokoyama et al. | |
| 5,185,590 | A | 2/1993 | DiVincenzo | |
| 6,812,815 | B2 | 11/2004 | Simms et al. | |
| 7,812,276 | B2 | 10/2010 | Maloney et al. | |
| 8,237,074 | B2 | 8/2012 | Tetik et al. | |
| 2009/0179009 | A1 | 7/2009 | Luders | |

FOREIGN PATENT DOCUMENTS

| | | | | |
|---|---|---|---|---|
| DE | 952192 | C * | 11/1956 | H01H 1/54 |
| DE | 2328971 | A1 * | 1/1975 | H01H 77/10 |
| EP | 0033479 | B1 | 7/1985 | |
| EP | 2447969 | A1 | 5/2012 | |
| FR | 1116920 | A * | 5/1956 | H01H 1/54 |
| GB | 1189948 | A | 4/1970 | |
| GB | 1405377 | A * | 9/1975 | H01H 73/045 |

OTHER PUBLICATIONS

Herbert DE 952192 C, machine translation.*

* cited by examiner

*Primary Examiner* — Mohamad Musleh
(74) *Attorney, Agent, or Firm* — Jason K. Klindtworth

(57) ABSTRACT

Various embodiments of a circuit breaker are described where a movable bridge connector is employed as part of the conductive path when the circuit breaker is in a closed configuration. When the circuit is opened, the connector is displaced from the two fixed contacts otherwise bridged by the connector. In one such embodiment, the circuit breaker utilizes the electromagnetic forces generated in response to the opening event to break the circuit.

10 Claims, 5 Drawing Sheets

ELECTROMAGNETICALLY ENHANCED CONTACT SEPARATION IN A CIRCUIT BREAKER

Embodiments presented herein relate generally to electrical circuit interruption using circuit breakers, such as to dual-break linear contact assemblies with magnetic cores in molded case circuit breakers (MCCB).

BACKGROUND

Circuit breakers are employed to interrupt AC or DC, single-phase or multi-phase electrical circuits when electrical fault conditions exist. The electrical fault conditions can include an instantaneous current in the electrical circuit that exceeds a predefined instantaneous current limit (i.e., an electrical short exists) or a long-term current that exceeds a predefined long-term current limit (i.e., an electrical overload exists). A single-break MCCB typically comprises one stationary contact mounted to a stationary current loop and a movable contact mounted to a rotatable contact arm for each phase. A dual-break MCCB comprises two stationary contacts and two movable contacts for each phase. In normal operation when electrical current flows through the device the movable contacts are in contact with the stationary contacts and the breaker is in the closed state. In the presence of an electrical fault the flow of electrical current is interrupted by separating the movable contacts from the stationary contacts, and the breaker is going from a closed to a tripped state. The contact arm is moved from a closed to a tripped position by means of a mechanism that acts on the contact arm.

The energy to move the contact arm may also come from electromagnetic fields that develop around the stationary current loop and the contact arm due to the electrical fault currents that flow through these components. The interactions between the electromagnetic fields and the fault current result in a repulsion force between the stationary current loop and the contact arm which, in conventional approaches, causes the contact arm to rotate and separate the movable contact from the stationary contact. As the movable contact begins to separate an arc may form between the stationary contact and the movable contact. Due to the electromagnetic fields there will be an arc force acting on the arc and affecting its path. The magnitudes of the repulsion force and the arc force diminish as the fault current and electromagnetic field intensity drop and as the alignment of the rotating contact arm with respect to the stationary current loop and with respect to the electromagnetic field becomes less favorable as the contact arm rotates.

The movement of the contact arm from the closed to the tripped position has to be fast to limit current and to minimize formation of arcs that may degrade the contacts. The circuit breaker mechanism also has to be of suitable size to fit in a predefined circuit breaker casing or electrical panel. Therefore, there is a need for maximizing the repulsion forces that accelerates the contact arm and for reducing the size of the mechanism.

BRIEF DESCRIPTION

In one embodiment, a circuit breaker is provided. The circuit breaker includes a latch assembly configured to release and to engage a cradle of the circuit breaker and a handle yoke configured to move between an open position and a closed position when the latch assembly is engaged to the cradle. The circuit breaker further includes a dual-break linear contact assembly that includes: a bridge connector configured to conductively connect stationary bus bars; a guide rod attached to the bridge connector and defining a linear movement path for the bridge connector; and a magnetic core disposed about the linear movement path and comprising at least a set of arc chute plates. The circuit breaker also includes a linkage assembly mechanically coupling the cradle, the handle yoke, and the guide rod, the linkage assembly having a spring which, at an operational current level, holds the bridge connector in place at the stationary bus bars when the latch assembly and cradle are engaged and when the handle yoke is in the closed position.

In an additional embodiment, a dual-break linear contact assembly is provided. The contact assembly includes a bridge connector configured to conductively connect contacts of two stationary bus bars. An electromagnetic repulsion force is generated and acts on the bridge connector when a current passes through the stationary bus bars and the bridge connector. The electromagnetic force pushes the bridge connector away from the stationary bus bars. The contact assembly also includes a biasing spring component that applies a force in opposition to the electromagnetic repulsion force to hold the bridge connector component in contact with the stationary bus bars when the current is below a current threshold.

In a further embodiment, a method for interrupting a circuit path is provided. In accordance with this method, stationary bus bars are connected with a bridge connector component. An electromagnetic repulsion force is generated acting on the bridge connector component when a current is passed through the stationary bus bars and the bridge connector component. The electromagnetic repulsion force pushes the bridge connector component away from the stationary bus bars. An opposing force is applied to the bridge connector component to overcome the electromagnetic repulsion force when the current is below a specified threshold. The bridge connector component is separated from the stationary bus bars when the current exceeds the specified threshold. The electromagnetic repulsion force exceeds the opposing force when the current exceeds the specified threshold.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

A dual-break linear contact assembly, as discussed herein, may be suitable for MCCBs used in residential, commercial or industrial applications, such as applications with voltages up to 1,000 V DC or AC, operational currents up to 2,000 A, and fault currents of up to 100 kA. As discussed herein, various embodiments of a dual-break linear contact assembly are described where a movable bridge connector is employed as part of the electrically conductive path when the circuit breaker is in a closed configuration. While the bridge connector may have a variety of shapes, including straight, in certain embodiments the connector is non-straight, such as curved (e.g., U-shaped or horseshoe shaped) or angled (e.g., V-shaped).

In the event of an electrical fault, a mechanism of the circuit breaker that is connected to the dual-break linear contact assembly is tripped, and the bridge connector in the dual-break linear contact assembly is linearly displaced away from the two stationary bus bars otherwise electrically connected by the bridge connector, thus opening the electrical circuit. In one such embodiment, the dual-break linear contact assembly utilizes the fault currents to generate forces to propel the bridge connector linearly away from the stationary bus bars, opening the electrical circuit. In one embodiment, as the bridge connector is moved away from the stationary bus bars, the fields due to the fault current result in an arc force that deflects any arcs that are present into proximate arc chutes. In such an embodiment, the arc chutes act to enhance the magnetic field to increase the magnitudes of the repulsion force and the arc force. Further, in one embodiment, an electrically isolating medium may be provided that is interposed between the two stationary bus bars as the bridge connector is linearly displaced from the fixed contacts. In this manner, the electrically isolating medium may help to prevent arc jumping between the two stationary bus bars or between the two movable contacts when the bridge connector separates from the stationary bus bars.

As discussed in greater detail below, embodiments of a dual-break linear contact assembly in accordance with the present approach may employ one or more magnetic cores that enhance the electromagnetic fields and, thereby, the repulsion force and the arc force generated in the presence of an electrical fault current. The repulsion force acts to displace the bridge connector away from the stationary bus bars, and the arc force acts to deflect the arc towards the arc chute plates. In one embodiment, a dome structure may enhance the magnetic circuit and hence increase the repulsion force and arc force near and at the end of the separation event.

Figure 1:
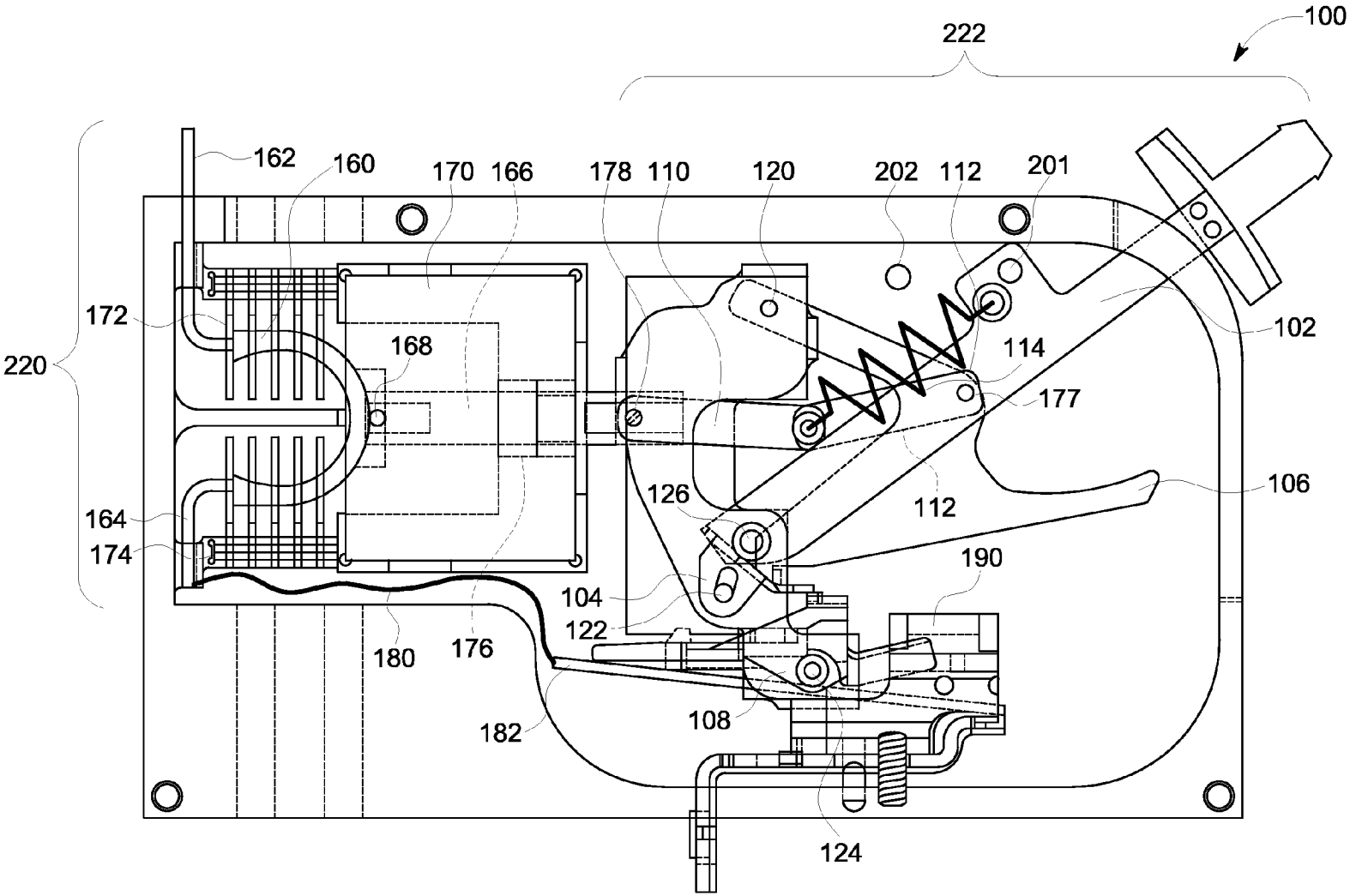
FIG. 1 depicts a schematic view of an embodiment of a circuit breaker with a dual-break linear contact assembly in a closed state, in accordance with aspects of the present disclosure.

With the preceding in mind, and turning to FIG. 1, a schematic view of certain components of an embodiment of a circuit breaker 100 with dual-break linear contact assembly 220 connected to a mechanism 222 are depicted that are in accordance with the present disclosure. In this example, the mechanism includes a handle yoke 102 that may be moved by a user, such as between open and closed states, or by operation of the circuit breaker 100 itself, such as when the circuit breaker 100 is tripped. In the depicted example, the circuit breaker 100 is in a closed state, as can be seen by the contact between the bridge connector 160 (here depicted as a curved or horseshoe-shaped connector) and stationary bus bars (e.g., first stationary bus bar 162 and the second stationary bus bar 164). When the bridge connector 160 is in contact with the stationary bus bars (i.e., when the circuit breaker 100 is in a closed state), current may flow through the circuit breaker 100.

In the depicted example, a latch assembly is depicted which, when engaged, acts to hold the bridge connector 160 in a closed position when the handle yoke 102 is in the corresponding closed position. The depicted latch assembly includes a primary latch 104 that can be engaged with a cradle 106 at one surface and with a secondary latch 108 at a second surface. As will be appreciated, the depicted latch assembly is a dual latch assembly (i.e., there are two engagement surfaces, the first between the primary latch 104 and the secondary latch 108 and the second engagement between the primary latch 104 and the cradle 106). In other embodiments, the latch assembly may differ, such as being a single latch assembly between a primary latch and cradle, or a triple or greater latch assembly, having more than two latches.

In the depicted example, the cradle 106 is operationally linked to the bridge connector 160 and to the handle yoke 102 via a linkage assembly that includes a first link 110, a second link 112, and a spring 114, along with the respective pins and other components for this assembly. In other embodiments, the cradle 106, handle yoke 102, and bridge connector 160 may be linked and/or may be coupled by other structural features, such as, in one embodiment, a flexure having different stable states that translate to different configurations of the circuit breaker 100 (such as a closed state, an open state, and a tripped state).

The mechanical motion of the components described above is determined (or constrained) by various revolute joints provided as part of the assembly. For example, certain of the revolute joints may be fixed with respect to the frame or support structure of the circuit breaker 100, such as revolute joints that are based on extensions or features of the frame wall or surface. For example, cradle pivot pin 120 forms a revolute joint about which the cradle 106 rotates with respect to the wall or frame of the circuit breaker 100, primary latch pivot pin 122 forms a revolute joint about which the primary latch 104 rotates with respect to the wall or frame of the circuit breaker 100, secondary latch pivot pin 124 forms a revolute joint about which the secondary latch 108 moves with respect to the wall or frame of the circuit breaker 100, and handle yoke pivot pin 126 forms a revolute joint about which the handle yoke 102 rotates with respect to the wall or frame of the circuit breaker 100. In the depicted example, the various fixed revolute joints, as well as revolute joints defined by the paired movable components, define the available motions and ranges for the depicted components in response to internally and externally applied forces.

In the depicted example, a central or median portion of the bridge connector 160 is connected to a guide rod 166, such as by a bridge connector pin 168. The guide rod 166, as discussed in greater detail below, acts to move the bridge connector 160 away from and toward the contacts of the first bus bar 162 and the second bus bar 164 based on the state of the circuit breaker 100 (i.e., whether the circuit breaker 100 is open, closed, or tripped).

Figure 2:
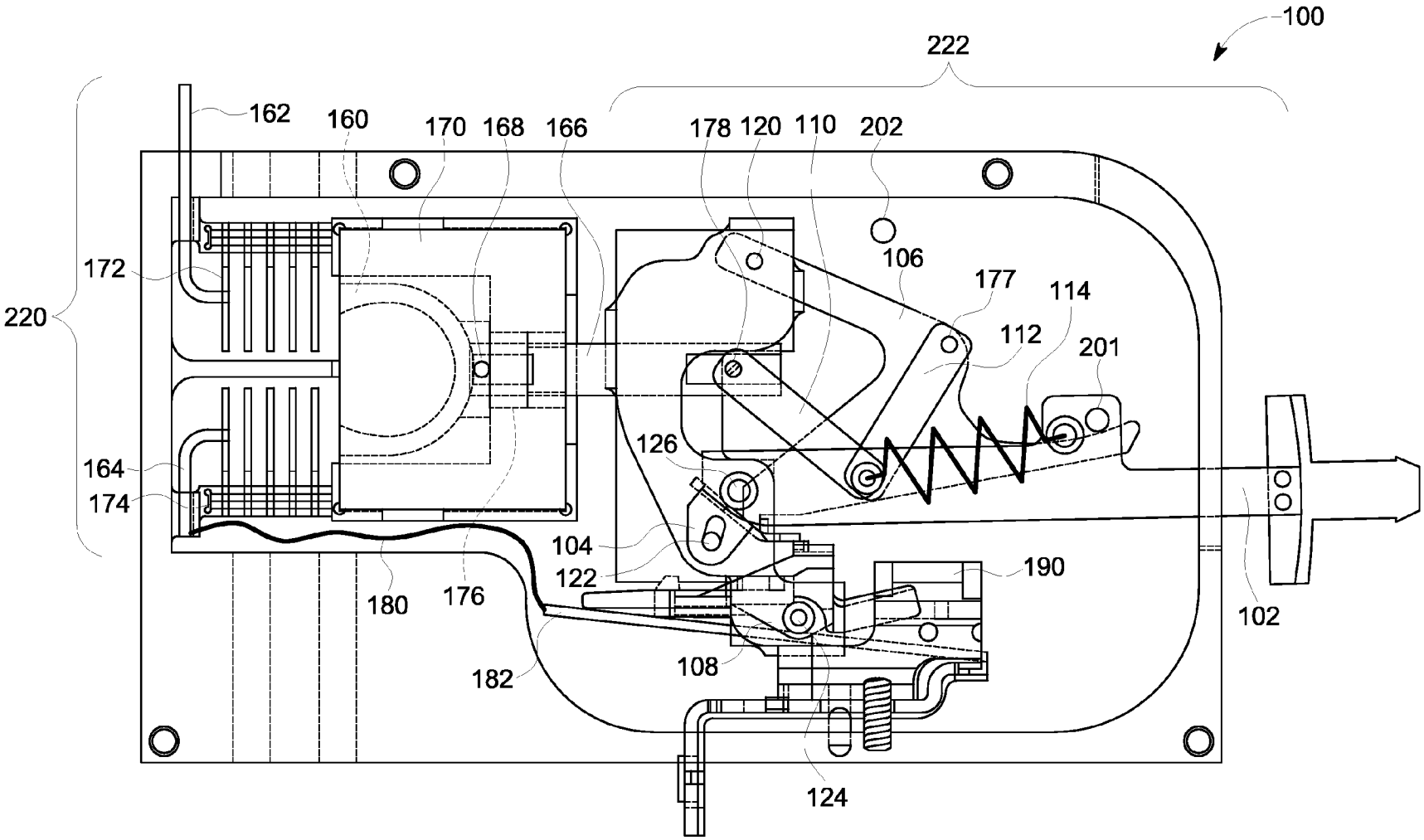
FIG. 2 depicts a schematic view of an embodiment of a circuit breaker with a dual-break linear contact assembly in an open state, in accordance with aspects of the present disclosure.
Figure 3:
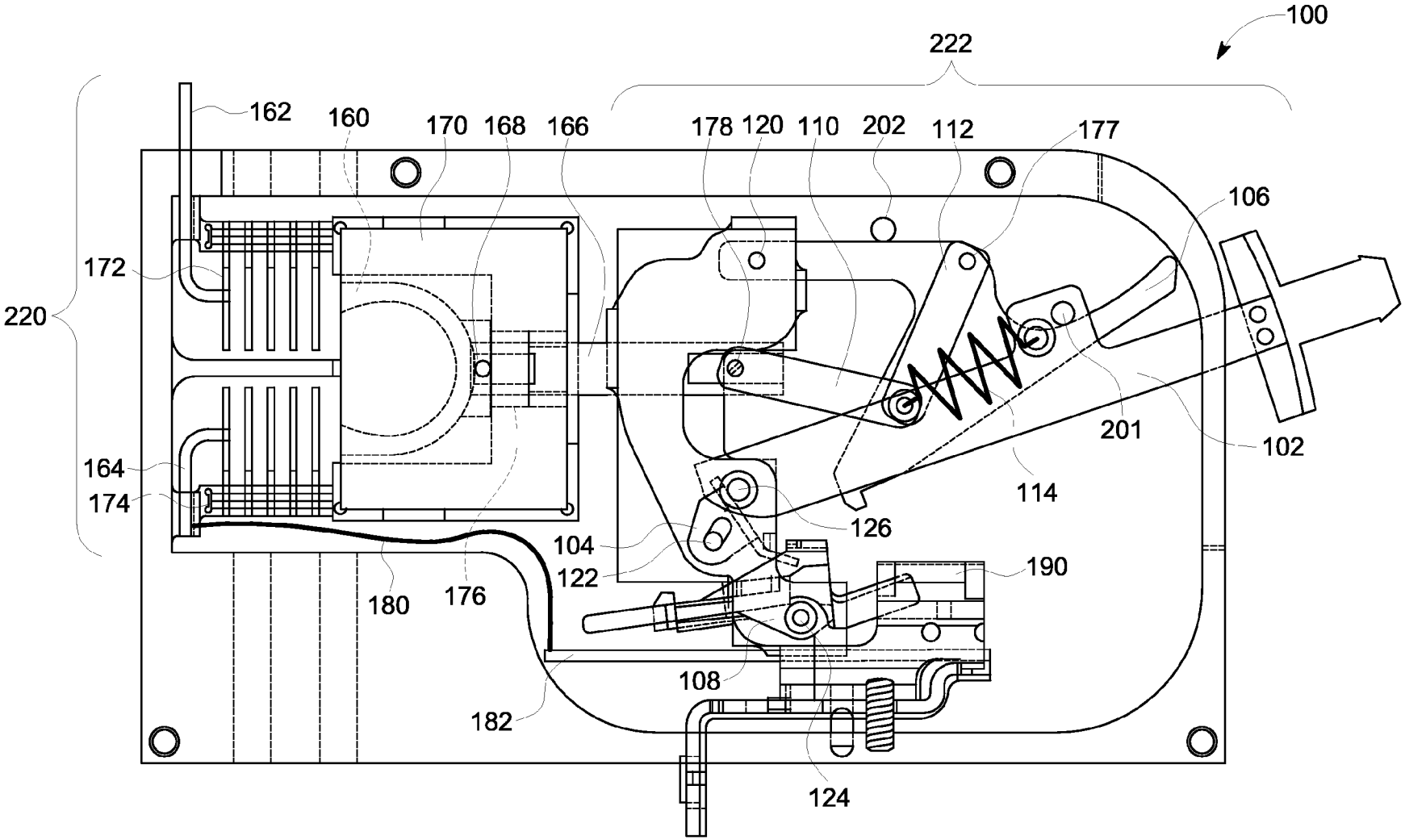
FIG. 3 depicts a schematic view of an embodiment of a circuit breaker with a dual-break linear contact assembly in a tripped state, in accordance with aspects of the present disclosure.
Figure 4:
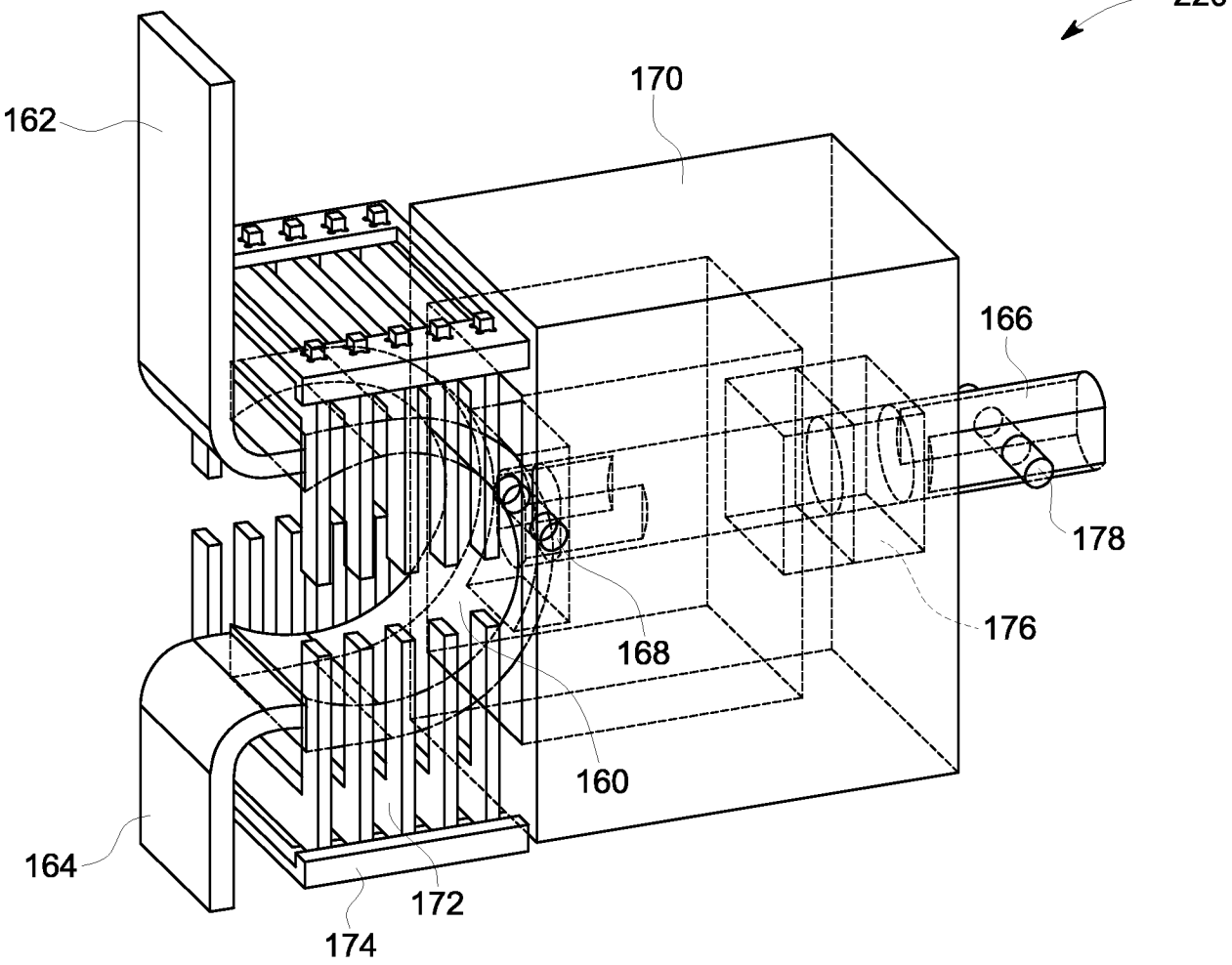
FIG. 4 depicts a perspective close-up view of a first embodiment of a dual-break linear contact assembly, in accordance with aspects of the present disclosure.

In the depicted example, movement of the bridge connector 160 away from the stationary bus bars may involve moving the bridge connector 160 through a magnetic core defined by a series of arc chute plates 172 and, in one embodiment, through or into a dome structure 170 which can be a laminated. FIG. 4 depicts a perspective close-up view of an embodiment of the bridge connector 160, arc chute plates 172, and dome structure 170. In one implementation, the spaced apart arc chute plates 172 may be positioned within an electrically isolating support frame 174. In the depicted example, the guide rod 166 may travel through a non-conductive linear bushing 176 disposed in or adjacent to the dome structure 170. As depicted in FIGS. 1-3, the guide rod 166 may be connected to the first link 110 of the linkage assembly via a connecting pin 178. The first link 110, in turn may be directly or indirectly linked to the handle yoke 102, the cradle 106, and the latching assembly.

Figure 5:
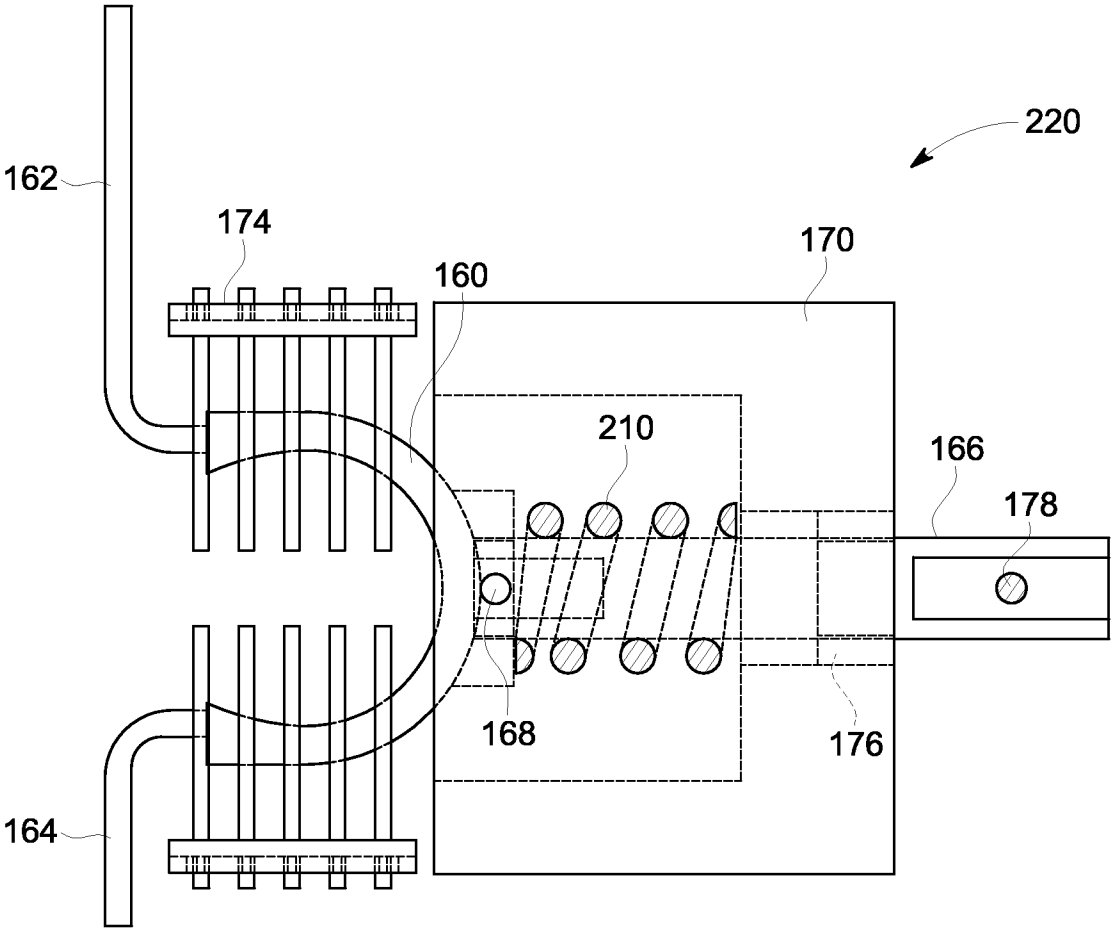
FIG. 5 depicts a schematic close-up view of a second embodiment of a dual-break linear contact assembly, in accordance with aspects of the present disclosure.

Turning to FIG. 5, a schematic close-up view of an embodiment of a dual-break linear contact assembly is depicted. This embodiment includes a secondary biasing spring 210 (shown in cross-section) positioned between bridge connector 160 and dome structure 170. The secondary biasing spring 210 is under compression and exerts a spring force on the bridge connector 160 such as to hold the bridge connector 160 in contact with the stationary bus bars 162, 164.

As will be appreciated, in the depicted example, the current flowing through the horizontal portion of the first stationary bus bar 162 and the horizontal portion of the second stationary bus bar 164 is equal in magnitude and opposite in direction, thereby generating a repulsion force acting on the bridge connector 160 which acts to push the bridge connector 160 away from the stationary bus bars 162, 164. However, in the depicted example, under normal operating conditions (i.e., no short circuit and no overcurrent), the secondary biasing spring 210 and the spring 114 of the linkage assembly may be calibrated or sized to overcome this repulsion force while the latching assembly remains engaged (i.e., in an un-triggered state) and the handle yoke 102 remains in the closed position. As will be appreciated, in other embodiments secondary biasing spring 210 and the spring 114 may be a type of biasing component capable of applying the specified bias force to the bridge connector 160 and overcome the repulsive force. However, in a short circuit situation, the repulsion force generated in the presence of short-circuit fault currents overcomes the bias force provided by the secondary biasing spring 210, causing the bridge connector 160 to separate from the stationary bus bars 162, 164 and move away from the stationary bus bars 162, 164. Subsequently, the electromagnetic flapper 190 trips the mechanism 222.

In the depicted example, a flexible conductor 180 (e.g., a flexible copper braid) is also shown which connects the second stationary bus bar 164 and a bimetallic strip 182 in contact with the latch assembly. In such an embodiment, the bimetallic strip 182, as discussed in greater detail below, may form part of a trip mechanism that can cause the latch assembly to disengage the cradle 106. In an overcurrent situation the bimetallic strip may undergo a conformational change and subsequent release of the cradle 106 by the latch assembly (i.e., tripping of the circuit breaker 100). In such a situation, disengagement of the cradle 106 from the latch assembly causes the spring 114 to move. This allows the repulsion force acting on the bridge connector 160 to separate the bridge connector 160 from the stationary bus bars 162, 164, thus opening the circuit and tripping the circuit breaker 100.

Turning to FIGS. 1-3, the circuit breaker 100 is shown in three differing operational configurations, closed in FIG. 1, open, in FIG. 2, and tripped in FIG. 3. For example, FIG. 1 depicts a schematic view of the circuit breaker 100 in a closed configuration. In this example, the bridge connector 160 connects the contacts of the first stationary bus bar 162 and second stationary bus bar 164. In particular, the latch assembly is engaged with the cradle 106 and the handle yoke 102 is in the closed position, resulting in the force of spring 114 overcoming the repulsion force during normal operation that acts on the bridge connector 160 to hold bridge connector 160 in the closed configuration.

In general, it may be desirable to move the circuit breaker 100 between the depicted closed position and an open position without tripping the circuit breaker 100. That is, it may be desirable to allow a user to open the electrical circuit in a manner distinct from tripping the electrical circuit. With this in mind, and turning to FIG. 2, the circuit breaker 100 of FIG. 1 is depicted in an open position, as shown by the bridge connector 160 being separated from the contacts of the first stationary bus bar 162 and second stationary bus bar 164.

The circuit breaker 100 may be opened in this manner by a user moving the handle yoke 102 from the position shown in FIG. 1 to the position shown in FIG. 2. In this open configuration, the latch assembly remains engaged with the cradle 106, however, the movement of the handle yoke 102 translates and rotates the spring 114, which results in a change of the force magnitude and force direction exerted by the spring 114 on the first link 110. As a result the second link 112 rotates counterclockwise about the revolute joint 177 which also moves the first link 110, the guide rod 166, and the bridge connector 160. In this manner, movement of the handle yoke 102 from the closed to the open position causes a linear translation of the bridge connector 160 away from the stationary contacts of the stationary bus bars 162, 164. As will be noted in this example, the electrical circuit is opened without tripping the circuit breaker 100 (i.e., the primary latch 104, secondary latch, 108, and cradle 106 all remain engaged). That is, the circuit breaker 100 may be opened without tripping the circuit breaker 100.

As noted above, in addition to the open and closed states, the circuit breaker 100 can also exist in a tripped state in which the circuit is opened. In general, once tripped, the circuit breaker 100 must be moved to the open configuration prior to being moved to the closed configuration. That is, because the latch assembly is disengaged when the circuit breaker 100 is tripped, the act of moving the handle yoke 102 to the open position shown in FIG. 2 acts to re-engage the primary latch 104, secondary latch, 108, and cradle 106 (i.e., to reset the MCCB 100), allowing the handle yoke 102 to then be moved to the closed position of FIG. 1 with the latch assembly engaged.

As noted above, with respect to the tripping of the circuit breaker 100 there may be at least two distinct mechanisms by which the circuit breaker 100 may be tripped, such as a mechanical tripping mechanism and electrical tripping mechanism. For example, the circuit breaker 100 may be tripped in the event of an electrical overload. In this circumstance, a bimetallic material, shown as bimetallic strip 182 may be heated and may deform (i.e., change shape or configuration) when a threshold temperature is reached (which is indicative of excessive current flow through the circuit breaker 100), causing release of the latch assembly and tripping of the circuit breaker 100 by mechanical force and displacement as discussed above. In other circumstances, an electromagnetic flapper 190 might be activated in the presence of a short circuit fault current. The flapper 190 may provide a force and displacement that disengages the latch assembly causing the circuit breaker 100 to trip.

In addition, as discussed herein, an electrical fault current may result in the repulsion force acting on the bridge connector 160 overcoming the force provided by the spring 114, thereby causing the bridge connector 160 to separate from the stationary bus bars, opening the electrical circuit. As the bridge connector 160 separates from the stationary contacts on the bus bars 162, 164, the electromagnetic forces resulting from the fault current may push any resulting arcs into the arc chute plates 172, which serve the dual function of both absorbing the arc energy as well as enhancing the electromagnetic field, which in turn increases the electromagnetic force acting on the bridge connector 160 to drive the bridge connector 160 away from the stationary bus bars. Thus, in this embodiment, the arc chute plates 172 enhance the electromagnetic field, and thereby increase the arc forces acting on the arcs as well as the repulsion force acting on the bridge connector 160. That is, the magnetic core formed by the arc chute plates 172 enhances the electromagnetic field and, thereby, the electromagnetic force generated during a short circuit that opens the circuit and extinguishes any arcs formed. Further, the dome structure 170 provides additional force enhancement at the end of the travel.

An example of a tripped circuit breaker 100 in accordance with present approaches is depicted in FIG. 3. In this example, the latch assembly has been disengaged (i.e., has been tripped), as shown by the separation or disengagement of the cradle 106 from the primary latch 104. In addition, the handle yoke 102 may be moved, in response to the action of the assembly, to a tripped position, which is located between the open position and the closed position of the handle yoke 102. While the depicted example employs rigid links to link the motions of the cradle 106, the handle yoke 102, the guide rod 166, the second link 112, and first link 110, as noted above, in other embodiments coordination of the motion of these components may instead be mediated by the operation of a flexure configured to transition between stable states in response to the circuit breaker being closed, opened, or tripped.

In numerical experiments, assuming a constant fault current of 10 kA and using a magnetic core disposed about the bridge connector 160 (in the form of arc chute plates 170 and dome structure 170), the force found to initially act on the bridge connector 160 and on the arcs in the event of a short circuit was 60 N and 3 N, respectively. Further, in this setup the force found to act on the bridge connector 160 and on the arcs after the bridge connector had traveled 10 mm away from the fixed contacts after a short circuit was found to be 62 N and 22 N, respectively. That is, the repulsion force associated with a given fault current is largely independent of the position of the bridge connector 160, with the forces acting on the bridge connector 160 being very similar both in the initial position (i.e., proximate to the fixed contacts) at the beginning of the fault as well as after the bridge connector 160 has traveled 10 mm away from the stationary contacts. Thus, the use of magnetic arc chute plates and a dome structure, as discussed herein, enhances the electromagnetic forces acting on the bridge connector 160 to cause separation in the event of an electrical fault and continues to provide a strong repulsion force even after the electrical circuit has been initially opened. Further, the increased arc forces seen when using a magnetic arc chute, as discussed herein, yield higher arc forces relative to implementations with no such arc chutes and, thereby, yield proportionately quicker arc extinction.

Technical effects of the invention include a circuit breaker having a dual-break linear contact assembly with a bridge connector that travels in a linear, non-rotating trajectory to separate from stationary bus bars and open the electrical circuit. Technical effects of the invention also include a circuit breaker and a dual-break linear contact assembly with magnetic cores, to enhance electromagnetic fields and the repulsion force applied to a bridge connector to separate the bridge connector from the stationary contacts of a first stationary bus bar and a second stationary bus bar when opening the circuit. Technical effects of the invention also include using the electromagnetic force generated by the flow of the fault current through a first stationary bus bar and a second stationary bus bar to repel a bridge connector connecting the first stationary bus bar and the second stationary bus bar in the event of an electrical fault condition.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A circuit breaker comprising:

a latch assembly configured to release and to engage a cradle of the circuit breaker;

a handle yoke configured to move between an open position and a closed position when the latch assembly is engaged to the cradle;

a dual-break linear contact assembly comprising:

a bridge connector configured to conductively connect stationary bus bars;

a guide rod attached to the bridge connector and defining a linear movement path for the bridge connector; and a magnetic core disposed about the linear movement path and comprising at least a set of arc chute plates;

a linkage assembly mechanically coupling the cradle, the handle yoke, and the guide rod, the linkage assembly comprising a spring which, at an operational current level, holds the bridge connector in place at the stationary bus bars when the latch assembly and cradle are engaged and when the handle yoke is in the closed position.

2. The circuit breaker of claim 1, wherein the bridge connector comprises a curved connector.

3. The circuit breaker of claim 2, wherein the curved connector comprises a horseshoe or U-shaped connector.

4. The circuit breaker of claim 1, wherein the bridge connector comprises an angled connector.

5. The circuit breaker of claim 4, wherein the angled connector comprises a V-shaped connector.

6. The circuit breaker of claim 1, wherein the spring is calibrated to overcome repulsion forces acting on the bridge connector and generated at the operational current level when the cradle is engaged with the latch assembly and when the handle yoke is in the closed position.

7. The circuit breaker of claim 1, further comprising an insulating component attached to the bridge connector opposite the guide rod.

8. The circuit breaker of claim 1, wherein the magnetic core further comprises a top core comprising a dome structure.

9. The circuit breaker of claim 1, wherein the cradle, when engaged with the latch assembly and when the handle yoke is in the open position, allows movement of the spring so that the spring does not bias the bridge connector of the linear contact assembly into contact with the stationary bus bars.

10. The circuit breaker of claim 1, wherein the cradle, when not engaged with the latch assembly, allows movement of the spring so that the spring does not bias the bridge connector of the linear contact assembly into contact with the stationary bus bars.

* * * * *